United States Patent [19]

Ball

[11] 4,113,085

[45] Sep. 12, 1978

[54] SEALING ARRANGEMENTS FOR USE UNDER WATER

[75] Inventor: Kenneth Ball, Hightown, England

[73] Assignee: Vickers-Intertek Limited, London, England

[21] Appl. No.: 771,356

[22] Filed: Feb. 23, 1977

Related U.S. Application Data

[62] Division of Ser. No. 685,676, May 12, 1976, which is a division of Ser. No. 456,769, Apr. 1, 1974, Pat. No. 3,968,656.

[51] Int. Cl.[2] ..... F16J 13/02; B63C 11/34

[52] U.S. Cl. ..... 277/9

[58] Field of Search ..... 277/24, 27, 9; 285/331, 285/360, 376, 401; 61/69 A

[56] References Cited

U.S. PATENT DOCUMENTS

| | | | |
|---|---|---|---|
| 1,803,526 | 5/1931 | Finn | 61/69 A |
| 1,853,898 | 4/1932 | Grieshaber | 61/69 A |
| 1,912,271 | 5/1933 | Furino | 61/69 A |
| 3,189,372 | 6/1965 | Johnson | 285/376 |
| 3,246,919 | 4/1966 | Todd | 285/360 |
| 3,345,085 | 10/1967 | Hanes | 285/27 |
| 3,459,442 | 8/1969 | Yarmett | 285/27 |
| 3,768,457 | 10/1973 | Beasey | 285/331 |
| 3,855,806 | 12/1974 | Therisien | 61/69 R |

*Primary Examiner*—Herbert F. Ross

*Attorney, Agent, or Firm*—Schrivener, Parker, Scrivener & Clarke

[57] ABSTRACT

A sealing arrangement between a transit capsule and a sub-sea capsule comprises a member(secured and sealed to the sub-sea capsule)which seals to the transit capsule but can be disengaged from the sub-sea capsule and carried by the transit capsule to the surface for repair of the seal between the member and the transit capsule. Means are described to ensure that the seal between the member and the sub-sea capsule is reliable.

4 Claims, 1 Drawing Figure

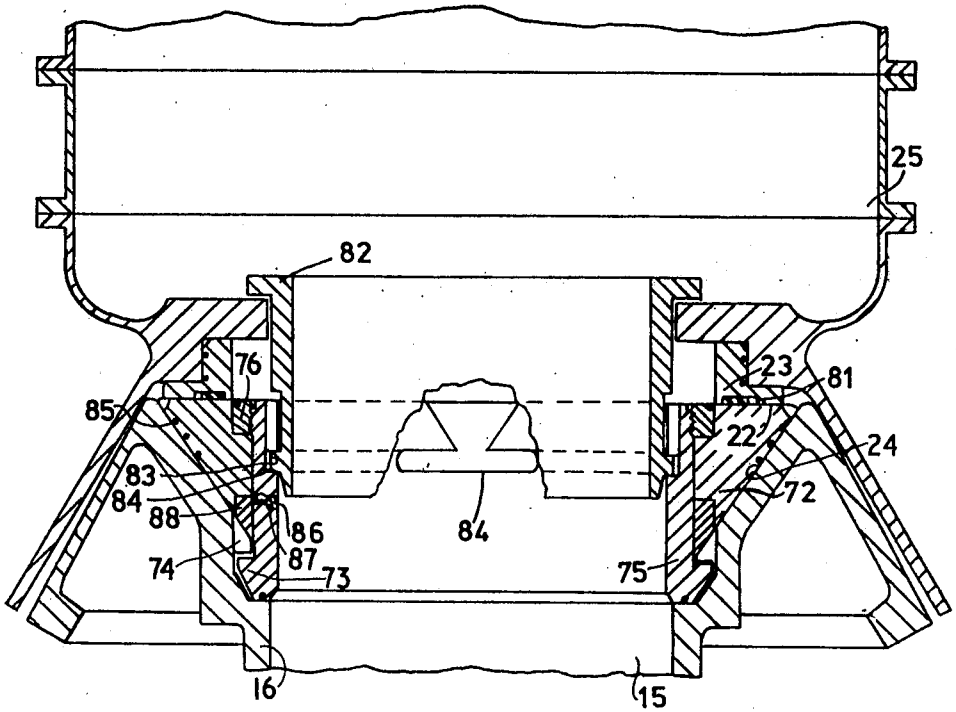
25
81
23
24
72
22
75
15
84
82
86
87
73
16
76
88
74
83
84
85

SEALING ARRANGEMENTS FOR USE UNDER WATER

This is a division of application Ser. No. 685, 676 filed May 12, 1976 which in turn is a division of application Ser. No. 456,769 filed Apr. 1, 1974, now U.S. Pat. No. 3,968,656 issued July 13, 1976.

The present invention concerns sealing arrangements for use underwater.

In some proposed methods of working underwater on subseal oil- and gas-wells, personnel travel down to an installation part in an air-filled transit capsule which is then locked onto the installation part and is sealed thereto to form a conjunction capsule containing, or permitting access to a further capsule containing, the installation part so that the personnel can gain access to the installation part whilst being protected from the external sea pressure. When the pressure in the conjunction capsule is reduced to atmospheric, the external pressure exerts a high force on the sealing arrangement which is thus rendered reliable. However if the sealing arrangement leaks initially, it is not possible to reduce the internal pressure and thus the personnel are restricted to the transit capsule. It is then necessary to try to repair the sealing arrangement by means of divers.

According to the present invention, there is provided a sealing arrangement for use underwater comprising the lower part of a transit capsule and means for co-operating therewith to form a sub-sea capsule, characterised by a member disposed in use between the transit capsule and said co-operating means and forming a seal therebetween, the member having means co-operating with means on the first-mentioned cooperating means whereby the member is releasably secured with a seal made between the member and the first-mentioned co-operating means, and the transit capsule carrying means for co-operating with means on the member whereby on control from the transit capsule the member can be released from the first-mentioned co-operating means, a main seal being provided between the transit capsule and an adjacent face of the member.

An embodiment of the present invention will now be described, by way of example, with reference to the accompanying drawing.

The drawing is a cross-section through a sealing arrangement according to the present invention.

DETAILED DESCRIPTION OF THE EMBODIMENT

The present invention is concerned with the problem of gaining access to a part of an installation permanently fixed to the sea-bed. The part is enclosed in a capsule 15 having a hatch (not shown) in an access pillar 16. The pillar in service co-operates with an open lower part of a chamber 25 carried by a transit capsule and accesible through a hatch (not shown) from the transit capsule. Between this lower part and the pillar there is a sealing arrangement. This sealing arrangement comprises a first face plate 23 permanently secured to the said lower part and presenting a face 22 with a seal groove containing a seal 81 to an adjacent face of a member 72, the said member 72 and a face 24 of the pillar. Said member is normally secured to the pillar by a releasable connection consisting of projections 73 locking behind other projections 74, the projections 73 being on the member and the projections 74 within the pillar or vice versa and being disengageable by relative twisting of the member. This releasable connection is thus somewhat similar to a bayonet connection but without the need to force down the connection before twisting to release the connection.

Seals of an elastomeric substance such as O-rings 85 are provided between the member and an abutting face of the pillar. The member can be adjusted to control the degree of pressure on these seals by having the member's projections on a collar 75 which is screw engaged wih the main portion of the member possibly by means of a nut-like collar 76 which is later welded to the main portion. A member 82 carried by, and for extension and rotation from within, the transit capsule fits within the passageway between the chamber 25 through the pillar and has projections 83 for gripping in T-shaped slots 84 (as illustrated in the centre of the drawing) in the member 72, which slots are open at their upper ends for the entry of the projections 83 into the slots.

Imagine a transit capsule coming down and seating with surfaces on the member 72 and the plate 23 coming into engagement. If the O-rings 85 make a perfect seal and the seal 81 is effective to allow the internal pressure to be reduced, the external pressure will force the face plate hard against the member 72 limiting the compression of the seal 81 to its designed value and also limiting leakage if the seal fails subsequently, an unlikely event. This is the intended method of operation. If the seal 81 is ineffective to allow the internal pressure to be reduced, then the projections 83 engaging in the slots 84 can twist the member 72 to free the projections 73 and 74 and allow the member 72 carried on the projections 83 to be returned to the surface by the transit capsule for inspection and repair or replacement of the member 72.

When the ring has been rectified or replaced, sealants and/or inhibitors can be injected through ducts 86 (which than then be sealed by plugs 87) to form a packing 88.

The transit capsule can be in the form of a self-propelled submersible craft (a miniature submarine).

I claim:

1. In and for a system for working on a fixed sub sea installation which system includes a transit capsule and a hollow body enclosing said installation, said body including an opening through which the interior of the body is normally exposed to the pressure of the surrounding water and wherein said transit capsule is sealingly engageable with said body around said opening so that the interior of said capsule and of said body can be subsequently connected together through said opening to form a sub sea capsule in which men can work on said installation at substantially atmospheric pressure, the invention comprising a sealing arrangement between said transit capsule and said body, comprising oppositely directed faces on said transit capsule and said body co-axially surrounding said opening, a member disposed between the capsule and said body and having faces complementary with the faces on said transit capsule and said body, said member being normally engaged with said body even in the absence of said transit capsule, a first seal disposed between the complementary faces on said member and on said body and a second seal disposed between the complementary faces on said member and on said transit capsule, and cooperating means carried by said member and said capsule and operable from within said capsule to break the seal between said member and body and disengage said member from said body while simultaneously connecting said member to said transit capsule for transport of said member by said capsule to a position remote from said body.

2. The sealing arrangement of claim 1 wherein said member is rotatable in opposite directions relative to said body for engaging and disengaging the latter, said cooperating means including a T-shaped slot on said member and an element carried by and operated from within said capsule and engageable with said slot for rotation of said member in one direction or the other to effect engagement with or disengagement from said body.

3. The sealing arrangement in accordance with claim 1 including cooperating releasable catch means carried by said body and said member for releasably retaining said member engaged with said body.

4. In and for a system for enabling men to work on a fixed sub-sea installation which system includes an air filled pressure-resistant transit capsule in which men can descend from sea-level to the installation at atmospheric pressure, and a body associated with the installation part sealingly engageable with the transit capsule around an opening to form a pressure resistant capsule which can be reduced in pressure to atmospheric pressure to allow the men to leave the transit capsule into an atmospheric pressure environment, the invention comprising a sealing arrangement between said transist capsule and said body, comprising oppositely directed faces on said transit capsule and said body co-axially surrounding said opening, a member disposed between the capsule and said body and having faces complementary with the faces on said transit capsule and said body, said member being normally engaged with said body even in the absence of said transit capsule, a first seal disposed between the complementary faces on said member and on said body and a second deal disposed between the complementary faces on said member and on said transit capsule, the member having a provision on its internal periphery engageable by an engagement means carried by and operable from within the transit capsule to disengage the member from the body and simultaneously connecting the member to the transit capsule whereby if the transit capsule on a descent cannot make a satisfactory seal with the member the member can be removed by the transit capable for repair to the seal at sea level, and the said engagement means carried by and operable from within the transit capsule.

* * * * *